United States Patent [19]

Edwards

[11] 3,940,660

[45] Feb. 24, 1976

[54] CIRCUITRY FOR LOAD CONNECTION AND DISCONNECTION

[76] Inventor: Frederick H. Edwards, 58 Sunset Ave., Amherst, Mass. 01002

[22] Filed: Dec. 14, 1973

[21] Appl. No.: 425,172

[52] U.S. Cl. ..... 315/360; 307/293; 307/141; 315/199; 315/291; 315/DIG. 4; 317/141 S

[51] Int. Cl.[2] ..... H05B 37/02; H01H 7/00

[58] Field of Search ..... 315/194, 199, 291, 360, 315/DIG. 4, 200 R, 209 R; 307/252 N, 293, 141, 141.8, ; 317/141 S

[56] References Cited

UNITED STATES PATENTS

| | | | |
|---|---|---|---|
| 3,414,738 | 12/1968 | Gilbreath | 307/293 X |
| 3,461,322 | 8/1969 | Hirsch et al. | 307/293 |
| 3,504,204 | 3/1970 | Carrive | 307/252 N X |
| 3,648,107 | 3/1972 | Rydborn | 315/360 |
| 3,767,937 | 10/1973 | Schmidgall | 307/141 X |
| 3,831,059 | 8/1974 | LoNigro | 315/360 X |
| 3,858,088 | 12/1974 | Scarpino et al. | 315/209 R X |

*Primary Examiner*—Archie R. Borchelt
*Assistant Examiner*—E. R. LaRoche
*Attorney, Agent, or Firm*—Ross, Ross & Flavin

[57] ABSTRACT

This invention relates to circuitry for the connection of a load to and disconnection of a load from an AC power source. The circuitry is specifically useful in the on/off control of such as incandescent lamps, but not exclusively so, and provides for the timed disconnection of a load when the load is connected in series with the circuitry and AC power source, or alternately provides for the timed reduction of power delivered to the load.

18 Claims, 2 Drawing Figures

CIRCUITRY FOR LOAD CONNECTION AND DISCONNECTION

A primary object of the invention is to provide a timed-off or a timed-reduced output of a household lamp or lamps by simply replacing the regular household on/off switch or switches with the control circuitry herein envisioned.

Such is not possible with prior art control circuits inasmuch as these circuits dictate that both AC power lines be available at the control circuit in order to provide control power for the circuit.

According to this invention, both AC power lines are not required at the control circuit, the circuits being designed to be inserted between the load and one line of the AC power source.

Since the voltage between the load and one AC power line may be very nearly zero when the load is connected, special techniques are employed to provide the control power required by the circuit.

The control power must be absorbed by the circuit-power supply element during time intervals when the load is not connected to the AC power source. As far as control power absorption is concerned, these time intervals can occur at any time during the cyclic variation of AC power. For example, the time of connection of the load at the beginning of each half-cycle or cycle of AC voltage alternation can be delayed until the AC voltage has risen sufficiently above zero to permit control power absorption. This technique I term phase control.

Another possibility is not to connect the load during 1-out-of-N cycles so that the control power can be absorbed during each cycle for which the load is not connected. This technique I identify as cycle-skipping control.

Practical applications occur wherever timed-off or timed-reductions in power delivered to a load may be desired, and wherever the control is placed in series with the load and power source. Such loads might conceivably be lamps, motor-driven devices, or the like.

Figure 1:
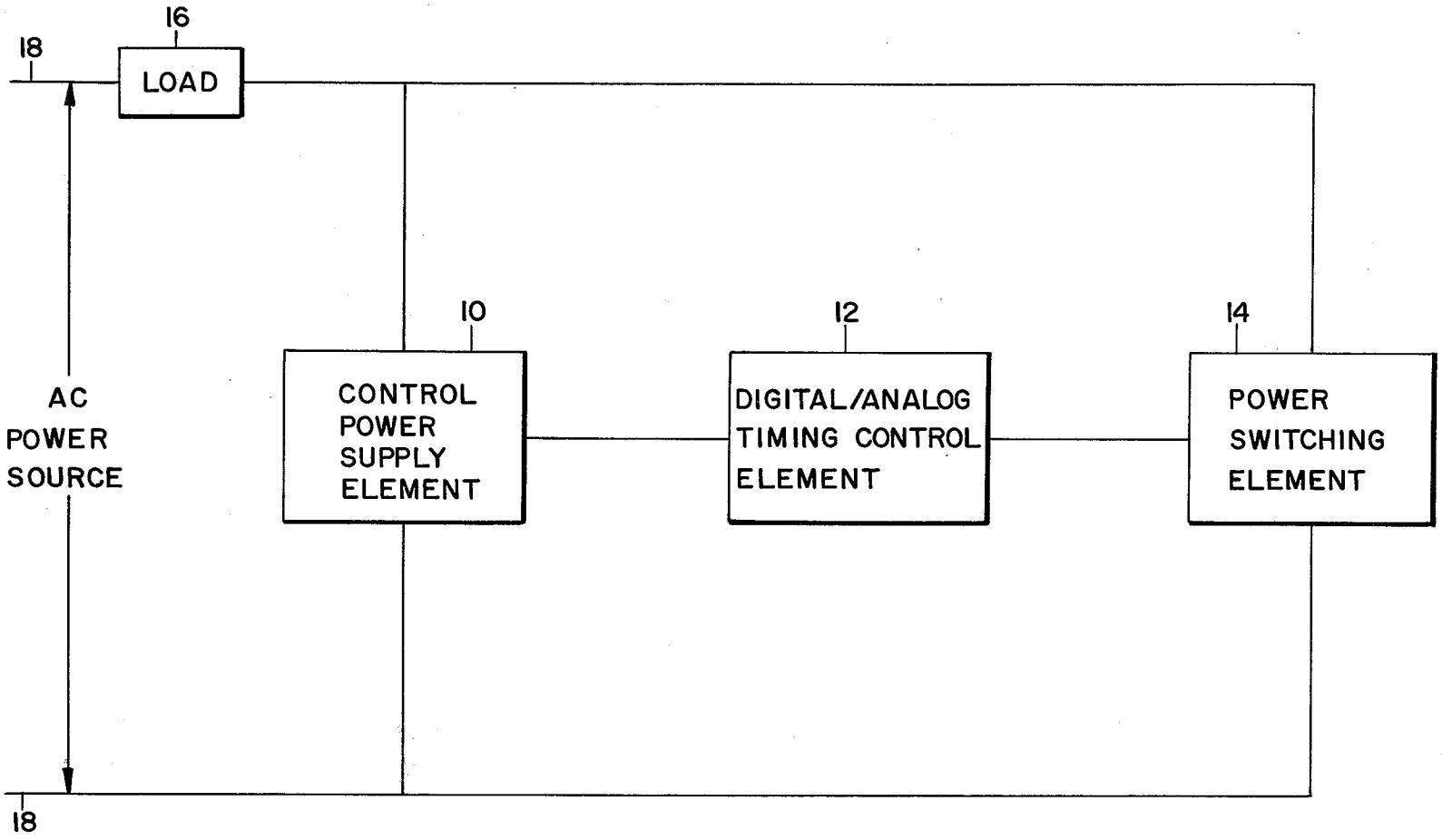
FIG. 1 shows the general scheme of the invention in block diagram form.

The FIG. 1 circuit shows the three basic elements of the invention: a control power supply element 10, a timing control element 12, and a power switching element 14. The circuitry is connected in series with the load 16 and AC power supply 18. Control power supply element 10 provides the control power required by timing control element 12 and power switching element 14.

The timing control and power switching elements provide for the manual connection of load 16 and for the automatic timed control of power delivered to the load.

Figure 2:
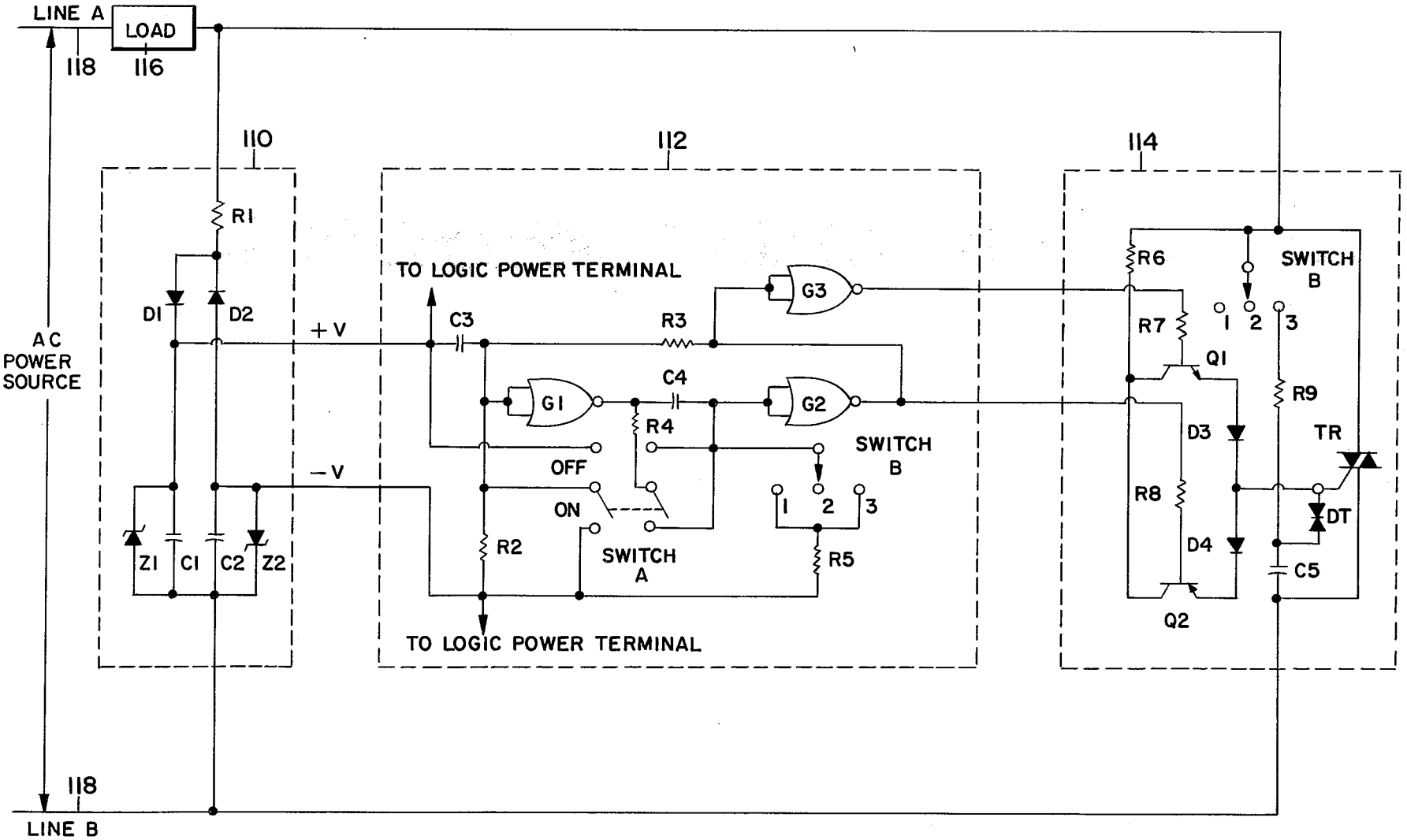
FIG. 2 shows one particular implementation of the general invention scheme as shown in FIG. 1.

The FIG. 2 circuit shows one particular implementation of the general scheme as exemplified in FIG. 1.

The control power supply element 110 corresponds to the equivalent FIG. 1 control power supply element 10.

The timing control element 112 corresponds to the equivalent FIG. 1 timing control element 12.

The power switching element 114 corresponds to the equivalent FIG. 1 power switching element 14.

The load is represented by 116 and the AC power supply is represented by 118.

Control power supply element 110 utilizes phase control comprehending a resistor R1, two diodes D1 and D2, two capacitors C1 and C2, and two zener diodes Z1 and Z2.

Capacitors C1 and C2 are charged at the beginning of each half-cycle of AC voltage alternation during time intervals determined by the instants at which load 116 is connected.

The phase control is provided by the unique design of the power switching element. If an insufficient charge exists on capacitors C1 and C2 so as to fail to provide the transistors with the base currents necessary to trigger the triac or thyristor here functioning within power switching element 114, then the circuit cannot switch and the voltage across the circuit will be caused to rise until a sufficient charge has accumulated so as to trigger the triac or thyristor.

Timing control element 112 comprises both analog and digital circuitry. An on/off control is incorporated into the digital circuitry composed of NOR gates G1, G2, and G3. The analog circuitry consists of capacitor C4 and resistor R5. NOR gates G1 and G2 are connected in a flip-flop configuration. Gate G3 is used as an inverter to supply an output state complementary to that of gate G2.

The on/off state of the circuit is determined by the state of the flip-flop, an on-state existing when the output of gate G2 is low (−V), and an off-state existing when the output of gate G2 is high (+V).

The flip-flop formed by gates G1 and G2 is initially set to the off-state when the AC power is energized by the circuit consisting of capacitor C3 and resistor R2. The on-state is achieved by moving switch A to its "on" position, this having the effect of discharging any charge that may exist on capacitor C4 through resistor R4, and of setting the flip-flop to the on-state by applying −V volts to the input terminals of gate G1. The resulting high output-state of gate G1 (+V) is transmitted to the input terminals of gate G2 by the capacitor C4-resistor R5 circuit.

This input state causes the output state of gate G2 to become low (−V) and this state is fed back to the input terminals of gate G1 so as to hold the flip-flop in the on-state.

The flip-flop can be operated in either a bistable or monostable mode. Bistable operation is obtained if switch B is moved to position 2; monostable operation is obtained if switch B is moved to position 1 or alternatively to position 3.

With switch B in either position 1 or position 3, the flip-flop is automatically returned to the off-state after a time interval determined by the capacitor C4-resistor R5 time constant. This occurs when capacitor C4 has charged to the point where the voltage developed across resistor R5 is too low to hold the output state of gate G2 low.

At this point, the output voltage of gate G2 rises to +V volts and such voltage is thereupon fed back to gate G1 so as to hold the flip-flop in the off-state.

The flip-flop can be manually returned to the off-state by moving switch A to its "off" position so as to apply +V volts to the input terminals of gate G1 thereby returning the flip-flop to the off-state, and simultaneously discharging capacitor C4.

If switch B is in position 2, the input terminals of gate G2 are not connected through resistor R5 to −V and capacitor C4 cannot charge. Consequently, this position of switch A results in bistable operation of the flip-flop. The flip-flop can only be returned to the off-state by means of switch A, and the circuit functions simply as a manual on/off (manual on/reduced power) switch.

Power switching element 114 includes two transistors Q1 and Q2, a triac or thyristor TR, a trigger diode DT, a resistor R9, and a capacitor C5.

When the control flip-flop formed by gates G1 and G2 is in the on-state, −V volts is applied to the base of transistor Q2 via resistor R8. This voltage results in Q2 collector current when line B is positive with respect to line A.

Similarly, when the flip-flop is in the on-state, the +V output voltage of gate G3 is applied to the base of transistor Q1 via resistor R7 and results in Q1 collector current when line B is negative with respect to line A. The transistor collector currents constitute the trigger currents for triac or thyristor TR.

When the flip-flop is in the off-state, no collector currents flow in transistors Q1 and Q2 and triac or thyristor TR is not triggered by this means. If switch B is in position 3, then the triac is triggered by the capacitor C5-resistor R9 circuit and trigger diode DT so as to provide a reduced power delivery to the load.

I claim:

1. In a circuit device for connection in series with a load and an AC power source such that power is delivered to the load during both positive and negative half-cycles and for the automatic disconnection of the load after a predetermined time interval, with the timing interval being variable over a period ranging from a few minutes to several hours and without restriction to a single value, the improvement comprising: output thyristor means for providing a conductive path for the load current, means connected to and controlling the output thyristor means for achieving conduction or nonconduction of the output thyristor means, timing circuit means connected to the controlling means for timing the automatic timing interval and including means for initiating or interrupting the automatic timing interval, means connected to the timing circuit means for changing the duration of the automatic timing interval, circuit voltage means for deriving a DC control voltage supply from the AC power source during periodic time intervals within the automatic timing interval when the output thyristor means is nonconductive, and means for providing the periodic time intervals during the automatic timing interval when the output thyristor means is nonconductive.

2. The circuit device as set forth in claim 1, the timing circuit means utilizing analog circuitry.

3. The circuit device as set forth in claim 1, the timing circuit means utilizing digital circuitry.

4. The circuit device as set forth in claim 1, the timing circuit means utilizing a combination of analog and digital circuitry.

5. The circuit device as set forth in claim 1, the load being a lamp.

6. The circuit device as set forth in claim 1, wherein the circuit device is substituted for a regular household on/off control switch.

7. The circuit device as set forth in claim 1, wherein the controlling means for the output thyristor means includes an NPN transistor and a PNP transistor.

8. The circuit device as set forth in claim 1, wherein the timing circuit means includes NOR gates connected in a monostable flip-flop configuration, the output of which is connected to a PNP transistor in the output thyristor controlling means and to another NOR gate, the output of which is connected to an NPN transistor in the output thyristor controlling means.

9. In a circuit device for connection in series with a load and an AC power source such that power is delivered to the load during both positive and negative half-cycles and for the automatic reduction of the load after a predetermined time interval, with the timing interval being variable over a period ranging from a few minutes to several hours and without restriction to a single value, the improvement comprising: output thyristor means for providing a conductive path for the load current, means connected to and controlling the output thyristor means for achieving conduction or nonconduction of the output thyristor means, means for adjustment of the reduced-load conduction of the output thyristor means, timing circuit means connected to the controlling means for timing the automatic timing interval and including means for initiating or interrupting the automatic timing interval, means connected to the timing circuit means for changing the duration of the automatic timing interval, circuit voltage means for deriving a DC control voltage supply from the AC power source during periodic time intervals within the automatic timing interval when the output thyristor means is nonconductive, and means for providing the periodic time intervals during the automatic timing interval when the output thyristor means is nonconductive.

10. The circuit device as set forth in claim 9, the load being a lamp.

11. The circuit device as set forth in claim 9, wherein the circuit device is substituted for a regular household on/off control switch.

12. The circuit device as set forth in claim 9, wherein the controlling means for the output thyristor means includes an NPN transistor and a PNP transistor.

13. The circuit device as set forth in claim 9, wherein the timing circuit means includes NOR gates connected in a monostable flip-flop configuration, the output of which is connected to a PNP transistor in the output thyristor controlling means and to another NOR gate, the output of which is connected to an NPN transistor in the output thyristor controlling means.

14. In a circuit device for connection in series with a load and an AC power source such that power is delivered to the load during both positive and negative half-cycles and provision is made for a choice between automatic timed disconnection of the load and automatic timed reduction of the load to some reduced load value and ordinary on/off control of power to the load, with neither the timed interval nor the reduced load value, being restricted to a single value but with the timed interval being variable over a period ranging from a few minutes to several hours, the improvement comprising: output thyristor means for providing a conductive path for the load current, means connected to and controlling the output thyristor means for achieving conduction or nonconduction of the output thyristor means, means for adjustment of the reduced-load conduction of the output thyristor means, timing circuit means connected to the controlling means for timing the automatic timing interval and including means for initiating or interrupting the automatic timing interval, means connected to the timing circuit means for changing the duration of the automatic timing interval, circuit voltage means for deriving a DC control voltage supply from the AC power source during periodic time intervals within the automatic timing interval when the output thyristor means is nonconductive, and means for providing the periodic time intervals during the automatic timing interval when the output thyristor means is nonconductive.

15. The circuit device as set forth in claim 14, the load being a lamp.

16. The circuit device as set forth in claim 14, wherein the circuit device is substituted for a regular household on/off control switch.

17. The circuit device as set forth in claim 14, wherein the controlling means for the output thyristor means includes an NPN transistor and a PNP transistor.

18. The circuit device as set forth in claim 14, wherein the timing circuit means includes NOR gates connected in a flip-flop configuration for operation in either monostable or bistable modes, the flip-flop output being connected to a PNP transistor in the output thyristor controlling means and to another NOR gate, the output of which is connected to an NPN transistor in the output thyristor controlling means.

* * * * *